US005291718A

United States Patent [19]

Moran

[11] Patent Number: 5,291,718

[45] Date of Patent: Mar. 8, 1994

[54] MASONARY TOOL FOR A CONCRETE BLOCK WALL

[76] Inventor: Victor Moran, 77 Carlton Ave., Apt. 2, Brooklyn, N.Y. 11205

[21] Appl. No.: 867,962

[22] Filed: Apr. 13, 1992

[51] Int. Cl.[5] ..... E04G 21/20

[52] U.S. Cl. ..... 52/749; 52/DIG. 1; 33/410; 33/518

[58] Field of Search ..... 52/DIG. 1, DIG. 2, DIG. 6, 52/436, 437, 749, 747; 33/404, 408, 410, 613, 562, 518

[56] References Cited

U.S. PATENT DOCUMENTS

| | | | |
|---|---|---|---|
| 1,163,210 | 12/1915 | Bush | 52/236.5 |
| 2,543,716 | 2/1951 | Carini | 52/749 |
| 2,940,298 | 6/1960 | Joseph | 52/749 |
| 3,148,453 | 9/1964 | Carlo | 33/410 |
| 3,212,191 | 10/1965 | Lessard | 33/410 |
| 3,397,458 | 8/1968 | Wicklund | 33/410 |
| 4,408,398 | 10/1983 | Glaze | 33/518 |

FOREIGN PATENT DOCUMENTS

| | | |
|---|---|---|
| 0152813 | 8/1953 | Austria . |
| 0548636 | 11/1957 | Canada . |
| 0387120 | 9/1990 | European Pat. Off. . |
| 2131474 | 6/1984 | United Kingdom . |
| 2136864 | 9/1984 | United Kingdom . |

*Primary Examiner*—Carl D. Friedman
*Assistant Examiner*—Winnie Yip
*Attorney, Agent, or Firm*—Michael I. Kroll

[57] ABSTRACT

A masonry tool is provided for a concrete block wall which consists of a mechanism for positioning a side end of a first concrete block, with mortar applied thereto, next to a side end of a second concrete block on the wall when being built, so as to form front and rear mortar joints therebetween. A structure on the positioning mechanism is for preventing the mortar from entering into a vertical open space in a third concrete block located below the front and rear mortar joints.

7 Claims, 2 Drawing Sheets

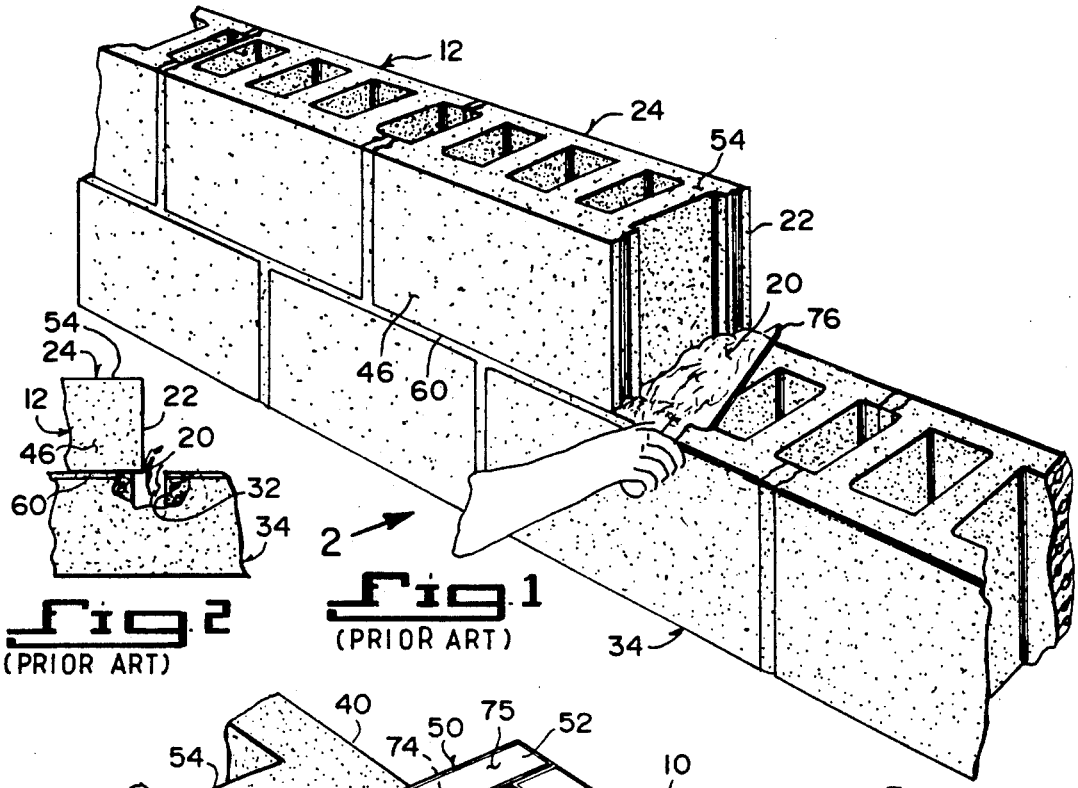
Fig. 1
(PRIOR ART)
Fig. 2
(PRIOR ART)
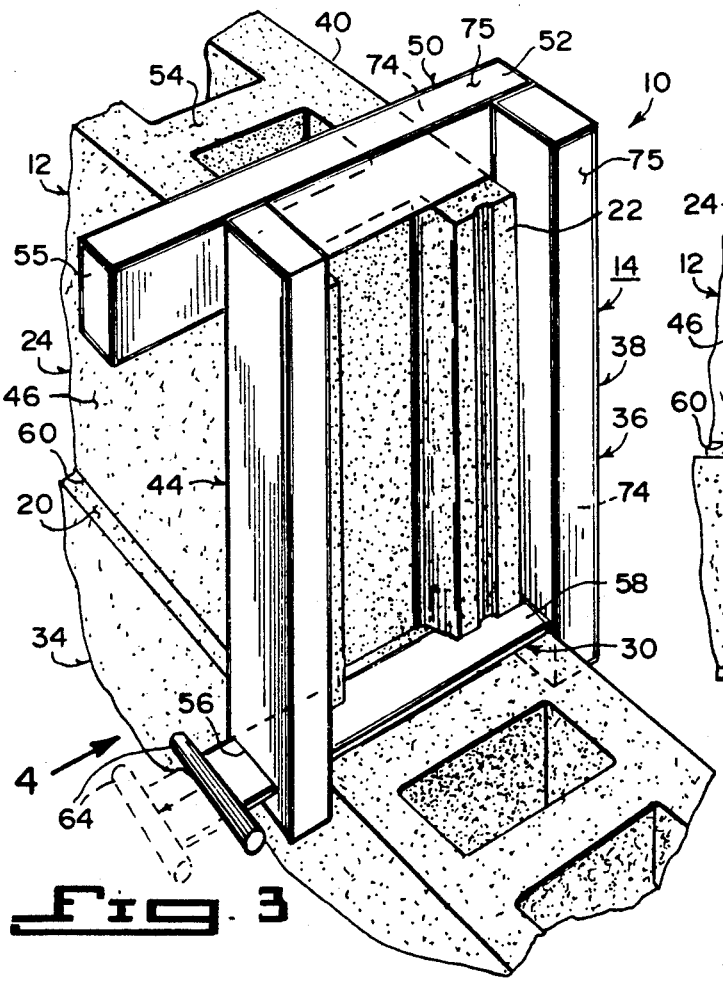
Fig. 3
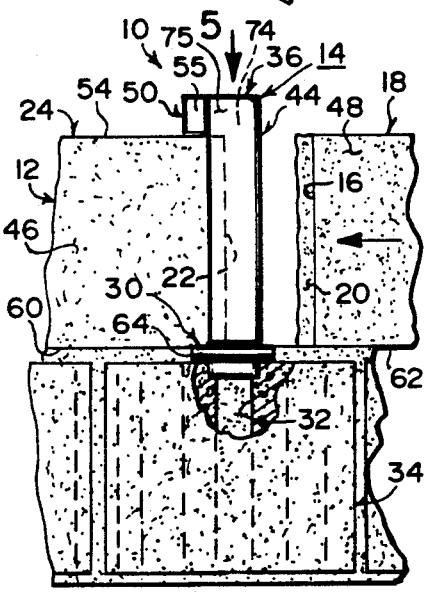
Fig. 4

MASONARY TOOL FOR A CONCRETE BLOCK WALL

BACKGROUND OF THE INVENTION

1. Field of the Invention

The instant invention relates generally to masonry equipment and more specifically it relates to a masonry tool for a concrete block wall.

2. Description of the Prior Art

In the prior art the task of joining concrete blocks with conventional materials by a person involved in the construction process is unaware that the work is being carried out in practical and uncomfortable way. The reasons listed are as follows:

1. The person must put the concrete block in an upright position to apply mortar to each end.
2. The person has to carry the concrete block to a wall that's being made with great caution, until such time as he locates it in a preliminary position. Once it is situated in the preliminary position the person must hit the concrete block with a hammer to get it to start to move into a correct position. The problem is that because of all this movement trying to find the corresponding alignments, both vertical and horizontal, the mortar would fall. Carrying a concrete block of eight, ten or twelve inches with applied mortar at its ends and getting that concrete block into its position is very difficult, due to the fact that a wall ascends. A scaffold is generally used, which furnishes very little balance the higher you go.
3. In order for two concrete blocks to be joined one end to the other and remain solid, there must be a process of bonding at the precise moment in which both concrete blocks are being joined. It is only at this moment and during the process of bonding that a compacted joint can be accomplished. The prior art used cannot accomplish this bonding for compactness, because the mortar placed on the two ends of the concrete block will not remain there at the end of the process. In order for the mortar to remain on the ends, it must be prepared correctly. If the mortar is hard there can be no bonding, because the concrete block is itself dry due to its own characteristics. If on the other hand you wet the concrete block, then the mortar will spill and will complicate the required finished work.

Numerous masonry equipment have been provided in prior art that are adapted to be utilized in building concrete block walls, foundations and the like. While these units may be suitable for the particular purpose to which they address, they would not be as suitable for the purposes of the present invention as heretofore described.

SUMMARY OF THE INVENTION

A primary object of the present invention is to provide a masonry tool for a concrete block wall that will overcome the shortcomings of the prior art devices.

Another object is to provide a masonry tool for a concrete block wall that will prevent mortar applied to a joint between the concrete blocks from falling down into a vertical open space in a lower concrete block when building the wall.

An additional object is to provide a masonry tool for a concrete block wall that will help position a concrete block being laid-up against another concrete block on the wall.

A further object is to provide a masonry tool for a concrete block wall that is simple and easy to use.

A still further object is to provide a masonry tool for a concrete block wall that is economical in cost to manufacture.

After all the objects already mentioned, one other object should be acknowledged and mentioned. That is that in using the masonry tool as the two concrete blocks are joined, a mold is formed into which the mortar is poured. Once the mortar is poured, it is spread with the same tool, a trowel, used to make the concrete blocks. This prevents the loss of mortar, which does not spill out because the mold keeps it from doing so. The mortar moves and penetrates into the pores of the concrete blocks, which allows for a foundation to be formed by the finished process.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of the prior art showing the laying-up of a course of concrete blocks to build a wall.

FIG. 2 is a front view taken in direction of arrow 2 in FIG. 1 with parts broken away showing the mortar falling into a vertical open space in a lower concrete block on the wall.

FIG. 3 is a perspective view of the instant invention installed at a side end of one of the concrete blocks on the wall.

FIG. 4 is a front view taken in direction of arrow 4 in FIG. 3 with parts broken away showing the blade covering the vertical open space in the lower concrete block on the wall and another concrete block ready to be installed on the wall.

DETAILED DESCRIPTION OF THE PREFERRED EMBODIMENTS

Figure 5:
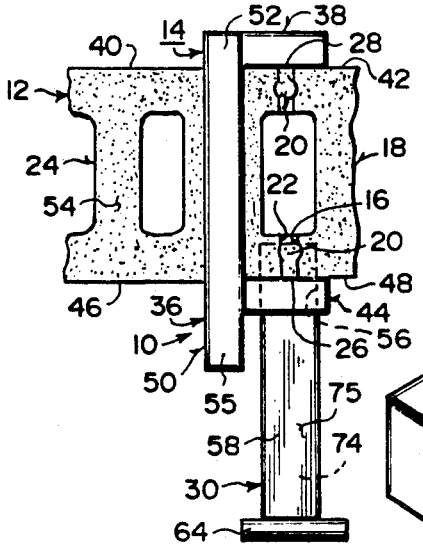
FIG. 5 is a top view taken in direction of arrow 5 in FIG. 4 with the blade partly pulled out therefrom.

Turning now descriptively to the drawings, in which similar reference characters denote similar elements throughout the several views, FIGS. 3, 4 and 5 illustrate a masonry tool 10 for a concrete block wall 12, which consists of a mechanism 14 for positioning a side end 16 of a first concrete block 18, with mortar 20 applied thereto, next to a side end 22 of a second concrete block 24 on the wall 12 when being built, so as to form front and rear mortar joints 26 and 28 therebetween. A structure 30 on the positioning mechanism 14 is for preventing the mortar 20 from entering into a vertical open space 32 in a third concrete block 34 located below the front and rear mortar joints 26 and 28.

The positioning mechanism 14 is a generally inverted U-shaped frame member 36 which is sized to fit about the side end 22 of the second concrete block 24, so that the side end 16 of the first concrete block 18 can fit into the frame member 36.

The generally inverted U-shaped frame member 36 contains a first stanchion 38 to cover a portion of a rear face 40 of the second concrete block 24 at the side end 22 thereof, a portion of a rear face 42 of the first concrete block 18 at the side end 16 thereof and the rear mortar joint 28 therebetween. A second stanchion 44 covers a portion of a front face 46 of the second concrete block 24 at the side end 22 thereof, a portion of a front face 48 of the first concrete block 18 at the side end 16 thereof and the front mortar joint 26 therebetween. A member 50 is for retaining the first stanchion 38 and the second stanchion 44 in a vertical parallel spaced apart relationship.

The retaining member 50 is a crossbar 52 attached to the top end of the first stanchion 38 and the top end of the second stanchion 44, in which the crossbar 52 will extend across a top surface 54 of the second concrete block 24. The crossbar 52 includes an extension segment 55 from the top end of the second stanchion 44, so that a person can grip the extension segment 55 with one hand to manipulate the generally inverted U-shaped frame member 36.

The mortar preventing structure 30 includes the second stanchion 44 having a horizontal slot 56 located at a bottom end thereof. A blade 58 fits through the horizontal slot 56 under a bottom surface 60 at the side end 22 of the second concrete block 24 to butt against a bottom end of the first stanchion 38. When the side end 16 of the first concrete block 18 is placed next to the side end 22 of the second concrete block 24 a bottom surface 62 at the side end 16 of the first concrete block 18 will fit over the blade 58. The blade 58 contains a transverse handle 64 at its forward edge, so that the person can grip the handle 64 with another hand to slide the blade 58 in and out of the horizontal slot 56 in the second stanchion 44.

Figure 6:
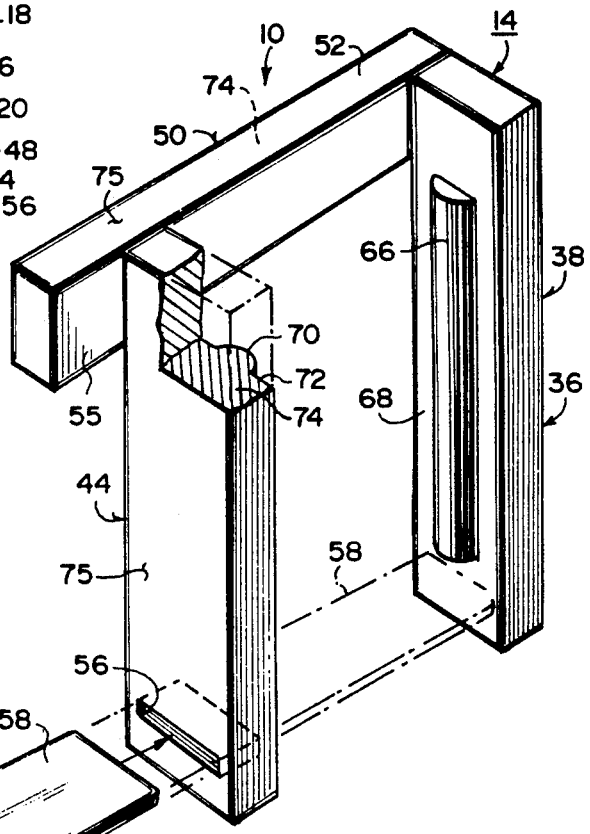
FIG. 6 is a perspective view of a modification with parts broken away and the blade completely pulled out therefrom.
Figure 7:
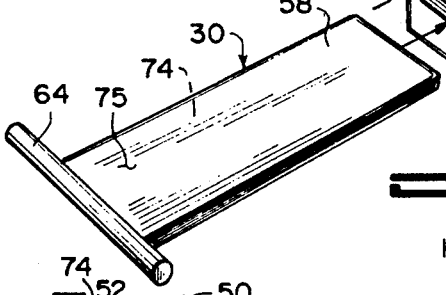
FIG. 7 is a perspective view of a portion of the modification installed at a side end of one of the concrete blocks on the wall.
Figure 8:
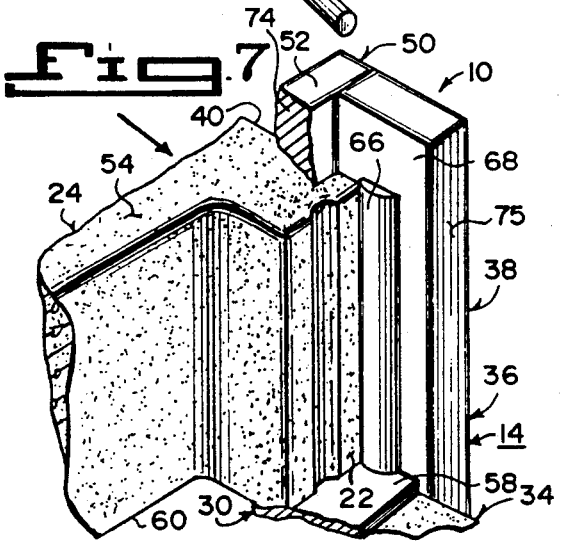
FIG. 8 is a front view of the concrete block wall with inwardly curved mortar joints formed thereon.
Figure 8:
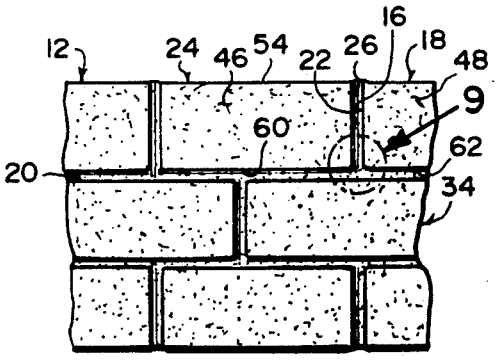
Figure 9:
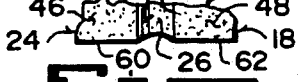
FIG. 9 is an enlarged front view as indicated by arrow 9 in FIG. 8 showing one of the inwardly curved mortar joints in greater detail.

The masonry tool 10, as shown in FIGS. 6 and 7, contains a first outwardly curved vertical member 66 on an inner surface 68 of the first stanchion 38 and is of a proper length to inwardly curve the rear mortar joint 28 (not shown) between the first concrete block 18 and the second concrete block 24. A second outwardly curved vertical member 70 on an inner surface 72 of the second stanchion 44 is of a proper length to inwardly curve the front mortar joint 26 (see FIGS. 8 and 9), between the first concrete block 18 and the second concrete block 24.

The first stanchion 38, the second stanchion 44, the crossbar 52 with the extension segment 55, the blade 58 and the transverse handle 64 are fabricated out of a durable material 74, typically but not limited to plastic, metal and wood.

The surfaces on the durable material of the first stanchion 38, the second stanchion 44, the crossbar 52 with the extension segment 55, the blade 58 and the transverse handle 64 are coated with a non-stick material 75, typically but not limited to polytetrafluoroethylene, so that the mortar 20 will not stick thereto.

Upon using the masonry tool 10 the person involved in the construction will immediately realize that the benefits acquired are immeasurable. The person will begin to save on time, energy, worry and alignment.

1. Time: With the masonry tool 10 the person does not have to stand the concrete block 18 on its end 16 to apply the mortar 20. He simply carries it from where it is to the place where the wall 12 is being constructed.
2. Energy: To carry a concrete block 18 with the mortar 20 to its designated place or where the wall 12 is being built, requires caution and much energy. If no mortar 20 is required on the concrete block end 16, until placed on its corresponding position, then it can be done with security and speed.
3. Worry: If a person is on a scaffold he need not concern himself with balance. Very little balance will be required since the concrete block 18 being carried has no mortar 20 on its end 16.
4. Vertical and horizontal alignment: The main function of the instant invention is in aligning the concrete blocks. The described disadvantages of the prior art used are rectified and made advantageous by the use of the masonry tool 10.

The masonry tool 10 is used after the second concrete block 24 is laid. When the first concrete block 18 is joined to the second concrete block 24, the first concrete block must also be vertically aligned with the second concrete block 24. A joint must be formed where the two concrete blocks 18 and 24 meet and this is the crucial function of the instant invention.

The masonry tool 10 is placed on the joint where the first concrete block 18 meets the second concrete block 24.

By putting the masonry tool 10 on the ends of both concrete blocks, it embraces the concrete blocks, giving them direction with respect to the course of the concrete blocks already laid. While embracing the two concrete blocks 18 and 24, it forms a mold. Now the mold is ready for the pouring of the mortar 20, which will join the two concrete blocks 18 and 24 into one solid body. Once the mortar 20 is poured into the mold, the masonry tool 10 is then removed the same way it was placed. This is done in a second and thus the labor is instantly reduced.

In the prior art it is being done in an uncomfortable and tedious way, due to lack of knowledge of a better way. But now because of the instant invention, many will realize the advantages of this new and better way, as they experiment for themselves.

The prior art in FIGS. 1 and 2 shows the concrete block wall 12 being built without the masonry tool 10. Some of the mortar 20 applied by a trowel 76 at the side end 22 of the second concrete block 24 will fall into the vertical open space 32 in the third concrete block 34 before the first concrete block 18 is put in place. This slows down the building of the concrete block wall 12 and also wastes the mortar 20 being used.

LIST OF REFERENCE NUMBERS 10 masonry tool
12 concrete block wall
14 positioning mechanism
16 side end of 18
18 first concrete block 20 mortar
22 side end of 24
24 second concrete block
26 front mortar joint
28 rear mortar joint
30 mortar preventing structure
32 vertical open space in 34
34 third concrete block
36 generally inverted U-shaped frame member for 14
38 first stanchion
40 rear face of 24
42 rear face of 18
44 second stanchion
46 front face of 24
48 front face of 18
50 retaining member
52 cross bar for 50
54 top surface of 24
55 extension segment of 52
56 horizontal slot in 44
58 blade
60 bottom surface of 24
62 bottom surface of 18
64 transverse handle on 58
66 first outwardly curved vertical member on 68
68 inner surface of 38
70 second outwardly curved vertical member on 72
72 inner surface of 44
74 durable material
75 non-stick material
76 trowel It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A masonry tool for a concrete block wall which comprises:

a) means for positioning a side end of a first concrete block, with mortar applied thereto, next to a side end of a second concrete block on the wall when being built, so as to form front and rear mortar joints therebetween, a generally inverted U-shaped frame member, which is sized to fit about the side end of the second concrete block, so that the side end of the first concrete block can fit into said frame member, said generally inverted U-shaped frame member includes a first stanchion to cover a portion of a rear face of the second concrete block at the side end thereof, a portion of a rear face of the first concrete block at the side end thereof and the rear mortar joint therebetween, a second stanchion to cover a portion of a front face of the second concrete block at the side end thereof, a portion of a front face of the first concrete block at the side end thereof and the front mortar joint therebetween, means for retaining said first stanchion and said second stanchion in a vertical parallel spaced apart relationship, said retaining means includes a top end of said first stanchion and a top end of said second stanchion, said retaining means is a crossbar attached to said top end of said first stanchion and said top end of said second stanchion, in which said crossbar will extend across a top surface of the second concrete block, said crossbar includes an extension segment from the top end of said second stanchion, so that a person can grip said extension segment with one hand to manipulate said generally inverted U-shaped frame member; and b) means on said positioning means for preventing the mortar from entering into a vertical open space in a third concrete block located below the front and rear mortar joints, said mortar preventing means includes said second stanchion having a horizontal slot located at a bottom end thereof, a blade which fits through said horizontal slot under a bottom surface at the side end of the second concrete block to butt against a bottom end of said first stanchion, so that when the side end of the first concrete block is placed next to the side end of the second concrete block, a bottom surface at the side end of the first concrete block will fit over said blade.

2. A masonry tool as recited in claim 1 wherein said blade includes a transverse handle at its forward edge, so that the person can grip said handle with another hand to slide said blade in and out of said horizontal slot in said second stanchion.

3. A masonry tool as recited in claim 1 further including:

a) a first outwardly curved vertical member on an inner surface of said first stanchion being of a proper length to inwardly curve the rear mortar joint between the first concrete block and the second concrete block; and b) a second outwardly curved vertical member on an inner surface of said second stanchion being of a proper length to inwardly curve the front mortar joint between the first concrete block and the second concrete block.

4. A masonry tool as recited in claim 3, wherein said first stanchion, said second stanchion and said crossbar with said extension segment are fabricated out of a durable material, typically to at least plastic, metal and wood.

5. A masonry tool as recited in claim 4, wherein said blade and said transverse handle are fabricated out of a durable material, typically to at least plastic, metal and wood.

6. A masonry tool as recited in claim 5, wherein the surfaces on said durable material of said first stanchion, said second stanchion and said crossbar with said extension segment are coated with a non-stick material, typically to at least polytetrafluoroethylene, so that no mortar will stick thereto.

7. A masonry tool as recited in claim 6, wherein the surfaces on said durable material of said blade and said transverse handle are coated with a non-stick material, typically to at least polytetrafluoroethylene, so that no mortar will stick thereto.

* * * * *